US006409573B1

(12) United States Patent
Mukai et al.

(10) Patent No.: US 6,409,573 B1
(45) Date of Patent: Jun. 25, 2002

(54) COMBINATION GRINDING MACHINE

(75) Inventors: Ryohei Mukai, Nagoya; Mamoru Katsuta, Kariya; Goro Terahara, Anjo; Tomohiko Yamaguchi, Aichi-ken; Shoichi Sano, Gamagori; Kazuo Machida, Kariya, all of (JP)

(73) Assignee: Toyoda Koki Kabushiki Kaisha, Karilya (JP)

( * ) Notice: Subject to any disclaimer, the term of this patent is extended or adjusted under 35 U.S.C. 154(b) by 0 days.

(21) Appl. No.: 09/550,333

(22) Filed: Apr. 14, 2000

(30) Foreign Application Priority Data

Apr. 14, 1999 (JP) ..... 11-106182

(51) Int. Cl.[7] ..... B24B 51/00

(52) U.S. Cl. ..... 451/5; 451/8; 451/11; 451/51; 451/65; 451/249; 451/251

(58) Field of Search ..... 451/51, 49, 65, 451/5, 8, 9, 10, 11, 249, 251

(56) References Cited

U.S. PATENT DOCUMENTS 3,710,514 A * 1/1973 Runge ..... 451/65
3,808,745 A * 5/1974 Belohoubek et al. ..... 451/65
3,881,887 A * 5/1975 McMaster ..... 451/49
4,090,422 A * 5/1978 Berbalk ..... 82/9
4,292,766 A * 10/1981 Kirk et al. ..... 451/11
4,498,259 A * 2/1985 Yamamoto et al. ..... 451/5
4,790,698 A * 12/1988 Heffron ..... 409/200
5,142,827 A * 9/1992 Phillips ..... 451/57
5,888,123 A * 3/1999 Wang ..... 451/65
5,951,377 A * 9/1999 Vaughn et al. ..... 451/49
6,106,373 A * 8/2000 Fabris ..... 451/57

* cited by examiner

*Primary Examiner*—M. Rachuba
(74) *Attorney, Agent, or Firm*—Oblon, Spivak, McClelland, Maier & Neustadt, P.C.

(57) ABSTRACT

A combination grinding machine grinds a plurality of axially arranged portions of a workpiece by use of a grinding wheel supported rotatably on a first wheel head and a superfinishing wheel supported rotatably on a second wheel head. A numerical control unit controls feed units for the first and second wheel heads in order to move the first and second wheel heads independently of each other in the axial direction of the workpiece and in the direction perpendicular to the axial direction, such that each of the axially arranged portions is ground by the grinding wheel, and simultaneously with this, another ground portion is superfinished by the superfinishing wheel.

25 Claims, 10 Drawing Sheets

FIG. 6

| MACHINING SEQUENCE | N1 | N2 | N3 | N4 | N5 |
|---|---|---|---|---|---|
| GRINDING WHEEL | P1 | P2 | P3 | P4 | Lg |
| SUPERFINISHING GRINDING WHEEL | Rg | P1 | P2 | P3 | P4 |
| REST SHOE | J2 | J2 | J3 | J4 | J4 |

IPMT

FIG. 7

| MACHINING SEQUENCE | N1 | N2 | N3 | N4 | N5 |
|---|---|---|---|---|---|
| GRINDING END POSITION | D1 | D2 | D3 | D4 | -- |
| SUPERFINISHING START POSITION | -- | D1' | D2' | D3' | D4' |

WPMT

COMBINATION GRINDING MACHINE

BACKGROUND OF THE INVENTION

1. Field of the Invention

The present invention relates to a combination grinding machine adapted to sequentially grind a plurality of axially separated portions to be machined (hereinafter, called merely object portions) of a rotatably supported workpiece by means of a pair of cooperative grinding wheels which are controlled independently of each other to be fed in the axial and radial directions of the workpiece.

2. Description of the Related Art

A combination grinding machine of this kind; particularly, that for grinding a crankshaft includes a pair of wheel heads which each include a grinding wheel and which can be numerically controlled independently of each other to be fed in the axial and radial directions of the crankshaft, which serves as the rotatably supported workpiece. The pair of grinding wheels are controlled so as to efficiently and cooperatively grind a plurality of crank pins two at a time according to a machining program stored in a numerical control unit.

During grinding, the crankshaft is rotated about the axis of journals, so that the crank pins revolve around the axis of journals. The wheel heads advance and retreat synchronously with crankshaft rotation so as to advance and retreat according to the angular positions of the corresponding revolving crank pins.

Conventionally, in order to improve the profile irregularity of ground portions, a crankshaft which has undergone grinding undergoes lapping. The thus-completed crankshaft is attached to, for example, a cylinder block of an internal combustion engine for automotive use. For lapping, a separate lapping machine is employed. In the lapping machine, ground surfaces of the crankshaft are lapped by means of tape-shaped sand paper or polishing film.

Since grinding and lapping are performed by use of different machines, a crankshaft must be transported from a grinding station to a lapping station. Also, idle time consumed, for example, for positioning on a lapping machine is involved, thus impairing machining efficiency. Because of intensive wear of sandpaper or polishing paper, lapping involves a problem of the sandpaper or polishing paper breaking. Therefore, lapping itself is not highly efficient.

Further mover, although conventional lapping can improve surface roughness, the conventional lapping has the following drawback. That is, in the conventional lapping, sandpaper or polishing film is merely pressed against a crank pin via a floating mechanism without accurate control of the spatial relationship (i.e., relative position) between the sandpaper or polishing film and a crank pin. As a result, the lapping process impairs high roundness and cylindricity of crank pins which have been accomplished in the preceding grinding process.

SUMMARY OF THE INVENTION

A primary object of the present invention is to solve the above-mentioned problem involved in the conventional machining in which grinding and lapping are performed separately from each other.

Another object of the present invention is to prevent an impairment in geometrical accuracy of object portions in a lapping process subsequent to a grinding process.

Still another object of the present invention is to efficiently grind and superfinish a plurality of object portions of a workpiece.

A further object of the present invention is to prevent unfavorable events involved in grinding—such as deflection of a workpiece derived from a mechanical contact between a grinding wheel and an object portion and vibration of the workpiece and machine—from having an adverse effect on final finishing performed on ground portions.

An additional object of the present invention is to perform highly efficient grinding without involvement of deflection of a workpiece in a grinding process, which involves a relatively heavy machining load, and to perform highly accurate final-finishing without involvement of rubbing of a ground surface against a mechanical member other than contact with a final-finishing tool in a final-finishing process, which involves a relatively light machining load.

A still further object of the present invention is to supply a sufficient amount of grinding solution to a region of grinding during grinding so as to prevent the occurrence of burning on a ground surface, and to eliminate an adverse effect of a dynamic pressure of grinding liquid supplied to a region of grinding during superfinishing so as to attain high finishing accuracy.

A still further object of the present invention is to enable efficient grinding and superfinishing of a plurality of journals and crank pins of a crankshaft through a single setup of the crankshaft on a grinding machine.

To achieve the above objects. the present invention provides a combination grinding machine comprising a first wheel head and a second wheel head, which can be controlled independently of each other to be fed in the axial direction of a rotatably supported workpiece and in a direction perpendicular to the axial direction. The first wheel head includes a grinding wheel, and the second wheel head includes a superfinishing wheel. Axially separated object portions of the workpiece which have been ground by means of the grinding wheel are superfinished by means of the superfinishing wheel, while the workpiece is continuously supported on the grinding machine without the manner of support being changed. In this way, grinding and superfinishing are combined.

Grinding and superfinishing are performed on a single machine, while the workpiece is supported by means of a workpiece support mechanism without the manner of support being changed, so that transfer of the workpiece from a grinding station to a superfinishing station becomes unnecessary. The position of a contact point of the grinding wheel with respect to the workpiece is varied together with the second wheel head, which can be advanced and retreated in an accurately controlled manner. Thus, the surface roughness of the object portion which has been ground by means of the grinding wheel of the first wheel head can be improved while the geometrical profile of the object portion, such as roundness and cylindricity, is maintained as finished accurately by means of the grinding wheel. Thus, machining can be performed intensively, and superfinishing accuracy is improved. Preferably, each of the grinding wheel and the superfinishing grinding wheel comprises a layer of CBN grains or diamond grains, which features a long grinding life. Preferably, the grinding wheel and the superfinishing wheel are disposed on the first and second wheel heads, respectively, in such a manner so as to face each other.

Preferably, a numerical control unit for controlling the grinding machine is programmed in the following manner. The grinding wheel of the first wheel head, which has its home position at one end of a common path, initially grinds the object portion which is located far from the home position; i.e., the object portion which is located near the other end of the common path, at which the home position of the second wheel head is located. Subsequently, the grinding wheel sequentially grinds the remaining object portions while the first wheel head is returning to its home position. The superfinishing wheel of the second wheel head sequentially superfinishes the object portions which have been ground by means of the grinding wheel, while the second wheel head is moving toward the home position of the first wheel head, and in parallel with grinding which is performed by means of the grinding wheel. Grinding and superfinishing are performed in parallel with each other on at least a portion of object portions, thereby shortening machining time per workpiece. Preferably, the grinding wheel starts grinding from the object portion which is located nearest to the home position of the second wheel head, and then grinds the remaining object portions while the first wheel head is returning to its home position. Also, the superfinishing wheel superfinishes the object portions which have been ground by means of the grinding wheel, while moving after the first wheel head toward the home position of the first wheel head. Thus, total time required for grinding and superfinishing can be minimized.

Preferably, grinding of one object portion and superfinishing of one ground object portion are performed in parallel with each other. Superfinishing is performed in parallel with fine grinding which is performed upon completion of rough grinding of the object portion. Superfinishing is performed in parallel with fine grinding, which is performed under gentle grinding conditions, not in parallel with rough grinding, which is performed under severe grinding conditions Thus, the accuracy of a superfinished surface can be prevented from being affected by vibration and deflection of the workpiece which would arise if superfinishing were performed in parallel with rough grinding. In view of shortening of machining time, preferably, grinding and superfinishing—in which an object portion to be ground and a ground object portion adjacent to the object portion simultaneously undergo grinding and superfinishing, respectively—are performed while the first and second wheel heads are moving toward the home position of the first wheel head. Herein, "fine grinding" may be a final grinding step involving a final feed for cutting of the grinding wheel, or an intermediate grinding step to be performed between a rough grinding step and the final grinding step.

Preferably, upon completion of grinding of each of the object portions, the spatial relationship (i.e., relative position) between the object portion and the grinding wheel is stored. When superfinishing is to be started, the superfinishing wheel is accurately positioned at a superfinishing start position on the basis of stored position data. Since superfinishing start position is determined on the basis of data regarding a tool position as detected upon completion of grinding of each of the object portions, the superfinishing wheel can be finely fed for cutting against a ground surface of the object portion. In the case of a workpiece exhibiting low rigidity and marked anisotropy in a direction of rotation, such as a crankshaft, a grinding wheel encounters difficulty in effecting accurate, fine feed for superfinishing. The present invention solves this problem. Also, the above-described means for solution can shorten a so-called idle feed time which is required at the beginning of superfinishing in order to bring the superfinishing wheel into contact with a ground surface of each of the object portions at an appropriate feed speed for cutting. Thus, machining efficiency is improved.

The position of the grinding wheel upon completion of grinding can be detected by means of an output from an absolute encoder, which constitutes the feed unit of the first wheel head and serves as position-detecting means. Alternatively, a contact point of the grinding wheel may be detected through use of optical or magnetic detection means. When superfinishing is to be performed, the superfinishing wheel is positioned on the basis of data regarding the position of the grinding wheel or the first wheel head as detected upon completion of grinding. Calculation of the superfinishing start position takes into account a diametral difference between the grinding wheel and the superfinishing wheel, and a positional difference between the first wheel head and the second wheel head with respect to the origin of the X-coordinate system; i.e., the machine origin, which is for example the axis of rotation of the workpiece. The numerical control unit may perform this calculation immediately after detection of the position of the grinding wheel or the first wheel head, or immediately before superfinishing is started.

Ablation of the grinding wheel derived from friction with the workpiece and that derived from truing which is performed for regeneration of the grinding surface of the grinding wheel can be detected through use of known detection means which involves direct or indirect contact with the grinding surface of the grinding wheel. However, in the case where high resolution of detection is required, the difference between the thus-detected apparent diameter and an actual diameter with respect to the grinding wheel becomes nonnegligible. In order for the numerical control unit to calculate an accurate superfinishing start position by rendering small an error derived from an apparent diameter of the grinding wheel, use of a grinding wheel of super abrasive is preferred, since a decrease in the diameter of such a grinding wheel is small over a long life.

Advantageously, a rest unit is provided in order to support the workpiece from opposite the grinding wheel at least when the grinding wheel performs rough grinding. However, the rest unit does not support the workpiece at least when the superfinishing wheel performs a final stage of superfinishing; specifically, final spark-out. At the final stage of superfinishing, elimination of mechanical friction between the workpiece and the rest shoe prevents chattering which would otherwise result from the mechanical friction, as well as an impairment in roughness of a superfinished surface of the workpiece.

Preferably, the present invention is applied to a crank-pin grinding machine of a C-X control system. The workpiece assumes the form of a crankshaft. The workpiece support mechanism supports the crankshaft such that the crankshaft rotates about the journal axis to thereby revolve crank pins around the journal axis. During grinding or subsequent superfinishing, the first or second wheel head advances or retreats synchronously with the phase angle of the revolving crank pin to be ground or superfinished.

Each of the crank pins is initially ground by means of the grinding wheel and is then superfinished by means of the superfinishing wheel. During grinding or superfinishing, rotation of the crankshaft and advancement/retreat of the first or second wheel head are synchronized. Thus, even though the rigidity of the crankshaft varies greatly with the angular position of rotation, the crank pins can be ground and superfinished highly efficiently and accurately. During grinding and subsequent superfinishing, support of the crankshaft effected by the workpiece support mechanism remains unchanged, whereby the superfinishing wheel can be finely fed for cutting against the ground surface of the crank pin. Preferably, immediately after each of the crank pins is ground, the crank pin is superfinished. Also, the position of the grinding wheel as detected upon completion of grinding is stored. On the basis of the position data, the superfinishing wheel is positioned before starting superfinishing. More preferably, grinding—which involves severe grinding conditions, such as a large grinding allowance—performed while the rest unit supports the crankshaft so as to prevent deflection of the crankshaft. Also, superfinishing; at least, the final stage of superfinishing—which involves a small grinding allowance—is performed while no mechanical contact is established between the crankshaft and the rest unit, thereby avoiding an adverse effect on final surface roughness which would otherwise result from the mechanical contact.

Advantageously, a large amount of coolant is supplied toward a region of grinding located between the grinding wheel and the object portion during grinding, which is performed under severe conditions. During superfinishing, which is performed so as to greatly improve profile irregularity, a small amount of coolant is supplied to the object portion, and oil mist serving as lubricant is sprayed over the superfinishing wheel. Decreasing of coolant supplied during superfinishing prevents chattering and generation of a dynamic pressure which would otherwise result from coolant caught between the object portion and the superfinishing wheel, thereby further improving a superfinished surface profile; i.e., geometrical accuracy and surface accuracy.

Preferably, a filter is employed for preventing entry of foreign matter into coolant supplied during superfinishing, and an amount of coolant supplied during superfinishing is not greater than 1/10 that of coolant supplied to the region of grinding during grinding. This eliminates chattering and generation of a dynamic pressure and prevents formation of scratches on a superfinished surface.

Preferably, in the case where the workpiece assumes the form of a crankshaft, before or after all crank pins are ground and superfinished, all journals of the crankshaft are ground and superfinished. This enables grinding and superfinishing of journals and crank pins of the crankshaft on a single grinding machine through involvement of a single setup of the crankshaft on the machine, thereby further improving machining accuracy and efficiency. Preferably, grinding and superfinishing of journals are performed prior to grinding and superfinishing of crank pins, which involve complicated control, such as angular control of crankshaft rotation, thereby achieving high accuracy of finishing of crank pins.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which:

FIG. 6 is an index position memory table formed in a RAM of the numerical control unit;

FIG. 7 is a wheel position memory table formed in the RAM of the numerical control unit;

DESCRIPTION OF THE PREFERRED EMBODIMENTS

Embodiments of the present invention will next be described in detail with reference to the drawings.

Figure 1:
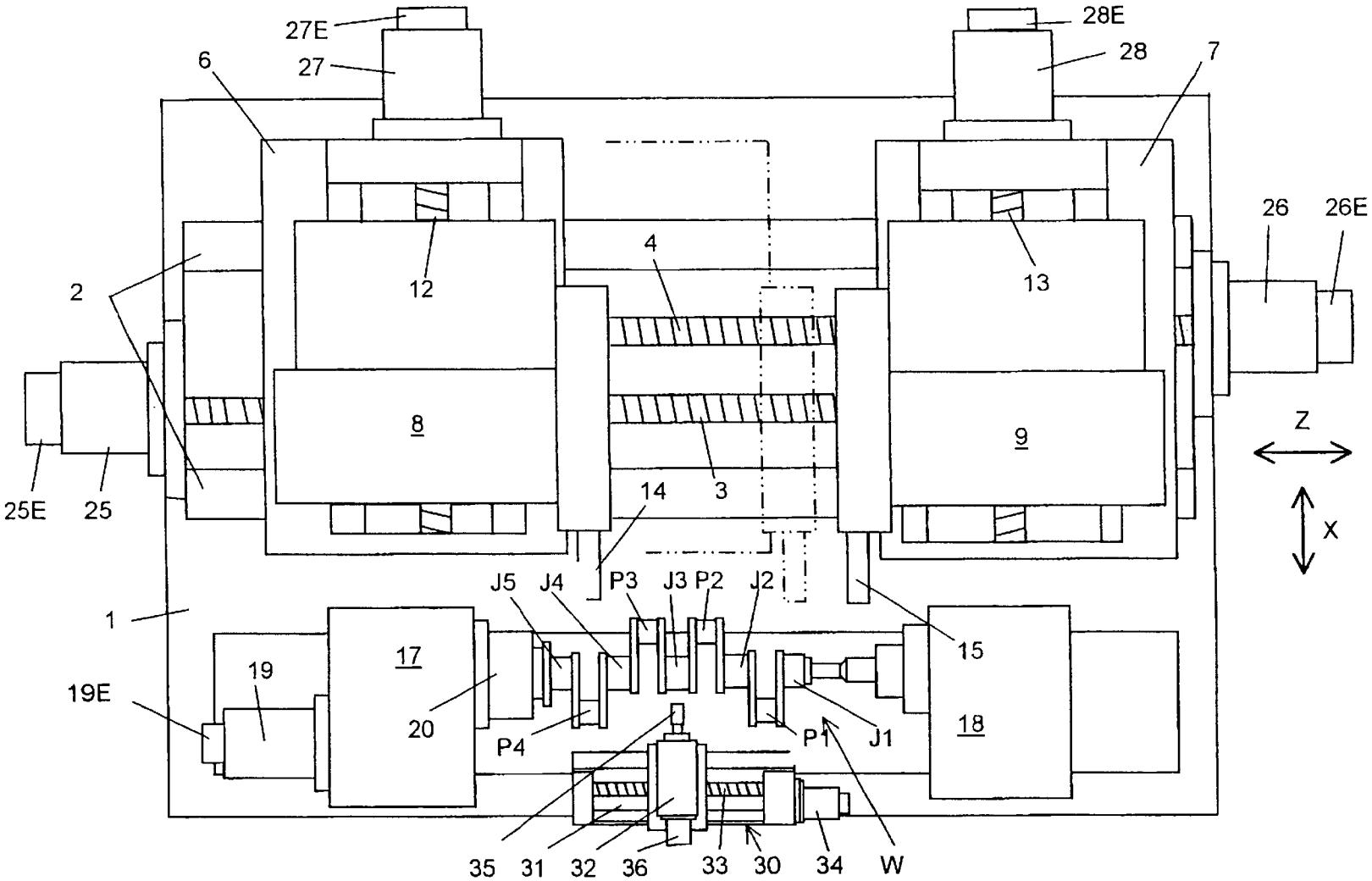
FIG. 1 is a plan view showing a crank-pin grinding machine, which is an embodiment of a combination grinding machine according to the present invention.

FIG. 1 shows a crank-pin grinding machine, which is an embodiment of the combination grinding machine according to the present invention. Z-axis guide rails 2 extend on a bed 1 in the longitudinal direction of the bed (Z-axis direction) or in the right/left direction in FIG. 1. A left-hand table 6 is disposed on the Z-axis guide rails 2 in such a manner so as to be slidable by means of a feed screw 3. A right-hand table 7 is disposed on the Z-axis guide rails 2 in such a manner so as to be slidable by means of a feed screw 4. A grinding-wheel head (first wheel head) 8 is disposed on the left-hand table 6 in such a manner so as to be slidable in a radial direction of a workpiece W (which will be described later); specifically, in a direction (X-axis direction) perpendicular to the Z-axis direction by means of a feed screw 12. Similarly, a superfinishing-wheel head (second wheel head) 9 is disposed on the right-hand table 7 in such a manner so as to be slidable in the X-axis direction by means of a feed screw 13. A grinding wheel 14 is rotatably supported by the grinding-wheel head 8. A superfinishing wheel 15 is rotatably supported by the superfinishing-wheel head 9.

A headstock 17 and a tailstock 18 are disposed apart from each other on the bed 1 and are located in front of the grinding-wheel and superfinishing-wheel heads 8 and 9. A crankshaft (workpiece) W is supported between the headstock 17 and the tailstock 18 by means of the respective centers. A C-axis servomotor 19 for rotating the crankshaft W is attached to the headstock 17. A chuck 20 of the headstock 17 chucks one end of the crankshaft W so as to rotate the crankshaft W. An encoder 19E attached to the rear end of the servomotor 19 detects the rotational position of the crankshaft W. The center of the tailstock 18 presses the center of the other end of the crankshaft W to thereby support the crankshaft W in cooperation. with the chuck 20.

The feed screws 3, 4, 12, and 13 are rotated by means of the corresponding servomotors equipped with an encoder under control of a numerical control unit, which will be described later. Specifically, a servomotor 25 equipped with an encoder 25E is connected to a left-hand end portion of the feed screw 3, which is adapted to move in the Z-axis direction the left-hand table 6 carrying the grinding-wheel head 8. A servomotor 26 equipped with an encoder 26E is connected to a right-hand end portion of the feed screw 4, which is adapted to move in the Z-axis direction the right-hand table 7 carrying the superfinishing-wheel head 9 A servomotor 27 equipped with an encoder 27E is connected to an end portion of the feed screw 12, which is adapted to move in the X-axis direction the grinding-wheel head 8 on the left-hand table 6. A servomotor 28 equipped with an encoder 28E is connected to an end portion of the feed screw 13, which is adapted to move in the X-axis direction the superfinishing-wheel head 9 on the right-hand table 7. The grinding wheel 14 and the superfinishing wheel 15 are attached. to the grinding-wheel head 8 and the superfinishing-wheel head 9, respectively, in such a manner so as to face each other. The grinding wheel 14 and the superfinishing wheel 15 are rotated by means of the corresponding unillustrated built-in motors, which are contained in the grinding-wheel head 8 and the superfinishing-wheel head 9, respectively.

The grinding wheel 14 and the superfinishing wheel 15 each comprise a disk-like substrate and a super abrasive layer having a thickness of 5–10 mm bonded to the circumferential surface of the substrate. The super abrasive layer is formed from diamond abrasive grains, preferably CBN abrasive brains, bonded together by means of vitrified bond. Preferably, the CBN abrasive grains contained in the abrasive layer of the grinding wheel 14 have an average grain size of about #80–#120; and the CBN abrasive contained in the abrasive layer of the superfinishing wheel 15 has an average grain size of about #400–#600.

A rest unit 30 is disposed on the bed 1 in opposition to the grinding-wheel head 8 and the superfinishing wheel bed 9 with respect to the crankshaft W. The rest unit 30 includes a rest base 31; a rest head 32; a feed screw 33 and a servomotor 34 equipped with an encoder, which are adapted to move the rest head 32 to an index position; a rest shoe 35 guided in the X-axis direction by means of the rest head 32; and a servomotor 36 equipped with an encoder, which is adapted to advance/retreat the rest shoe 35 in a radial direction of the crankshaft W. In the case of the illustrated crankshaft W for use in a 4-cylinder engine, during grinding, the rest shoe 35 is selectively moved to one of index positions corresponding to three central journals; i.e., journals J2, J3, and J4 (the second through fourth journals from the tailstock 18). In the thus-indexed position, the servomotor 36 causes the rest shoe 35 to advance until the rest shoe 35 comes into contact with the relevant journal, thereby preventing deflection of the crankshaft W In the crank-pin grinding machine according to the present embodiment and having the above-described structure, the crankshaft W is supported between the headstock 17 and the tailstock 18. During grinding, the servomotor 25 moves the left-hand table 6 such that the grinding wheel 14 is sequentially moved to index positions aligned with crank pins P1–P4. Next, the servomotor 19 of the headstock 17 is rotated so as to rotate the crankshaft W. Since the crankshaft W is rotated about the axis of its journals J3–J5, the crank pins P1–P4 to be ground revolve around the axis of the journals J3–J5. Then, the servomotor 27 causes the grinding-wheel head 8 to advance. Since the crank pins P1–P4 are revolving, the numerical control unit causes the grinding-wheel head 8 to advance and retreat synchronously with rotation of the servomotor 19, thereby performing grinding by means of the grinding wheel 14. In addition to this synchronous motion, the servomotor 27 gradually advances the grinding wheel 14 for infeed so as to finish the relevant crank pin to a predetermined dimension.

According to a feature of the present invention, grinding is performed in the following manner. First, the grinding wheel 14 is positioned so as to align with the first pin P1, which is located nearest to the home position of the superfinishing-wheel head 9. The grinding wheel 14 grinds the pin P 1. Subsequently, in the process of the left-hand table 6 moving to its home position located at the left-hand end of its longitudinal stroke of movement in FIG. 1, the grinding wheel 14 is positioned so as to sequentially align with the second pin P2, the third pin P3, and the fourth pin P4, to thereby grind the pins P2–P4 sequentially. That is, in the process of the left-hand table 6 moving to its home position from the position illustrated by the imaginary line in FIG. 1 and located nearest to the home position of the superfinishing-wheel head 9 (a right-hand origin of longitudinal indexing), the crank pins P1–P4 are ground sequentially. After all of the crank pins P1–P4 are sequentially ground by means of the grinding wheel 14, the left-hand table 6 is returned to its home position, which is a left-hand origin of longitudinal indexing. While the left-hand table 6 is positioned in its home position, the grinding wheel 14 stands by in such a position that allows the superfinishing wheel 15 to align with the journal J5.

Superfinishing is performed in the following manner. When, after completion of grinding of the first pin P1, the left-hand table 6 is moved to an index position where the grinding wheel 14 aligns with the second in P2, the servomotor 26 causes the right-hand table 7 to move from its home position to an index position where the superfinishing wheel 15 aligns with the first pin P1. Then, the superfinishing wheel 15 starts superfinishing the pin P1. Subsequently, when the left-hand table 6 is moved sequentially to index positions where the grinding wheel 14 aligns with the third pin P3 and the fourth pin P4, the right-hand table 7 follows the movement of the left-hand table 6 and is moved sequentially to index positions where the superfinishing wheel 15 aligns with the second pin P2 and the third pin P3. When the left-hand table 6 is returned to its home position, where the grinding wheel 14 faces the chuck 20 or the headstock 17, the right-hand table 7 is moved to an index position where the superfinishing wheel 15 aligns with the fourth pin P4. When the right-hand table 7 is positioned in each of the index positions, the servomotor 28 causes the superfinishing-wheel head 9 to advance. While rotating regularly and in reverse synchronously with rotation of the servomotor 19, the servomotor 28 feeds the superfinishing-wheel head 9 from a superfinishing start position so as to gradually finish the relevant crank pin to a predetermined dimension. Upon completion of superfinishing of the fourth pin P4, the right-hand table 7 returns to its home position.

Figure 2:
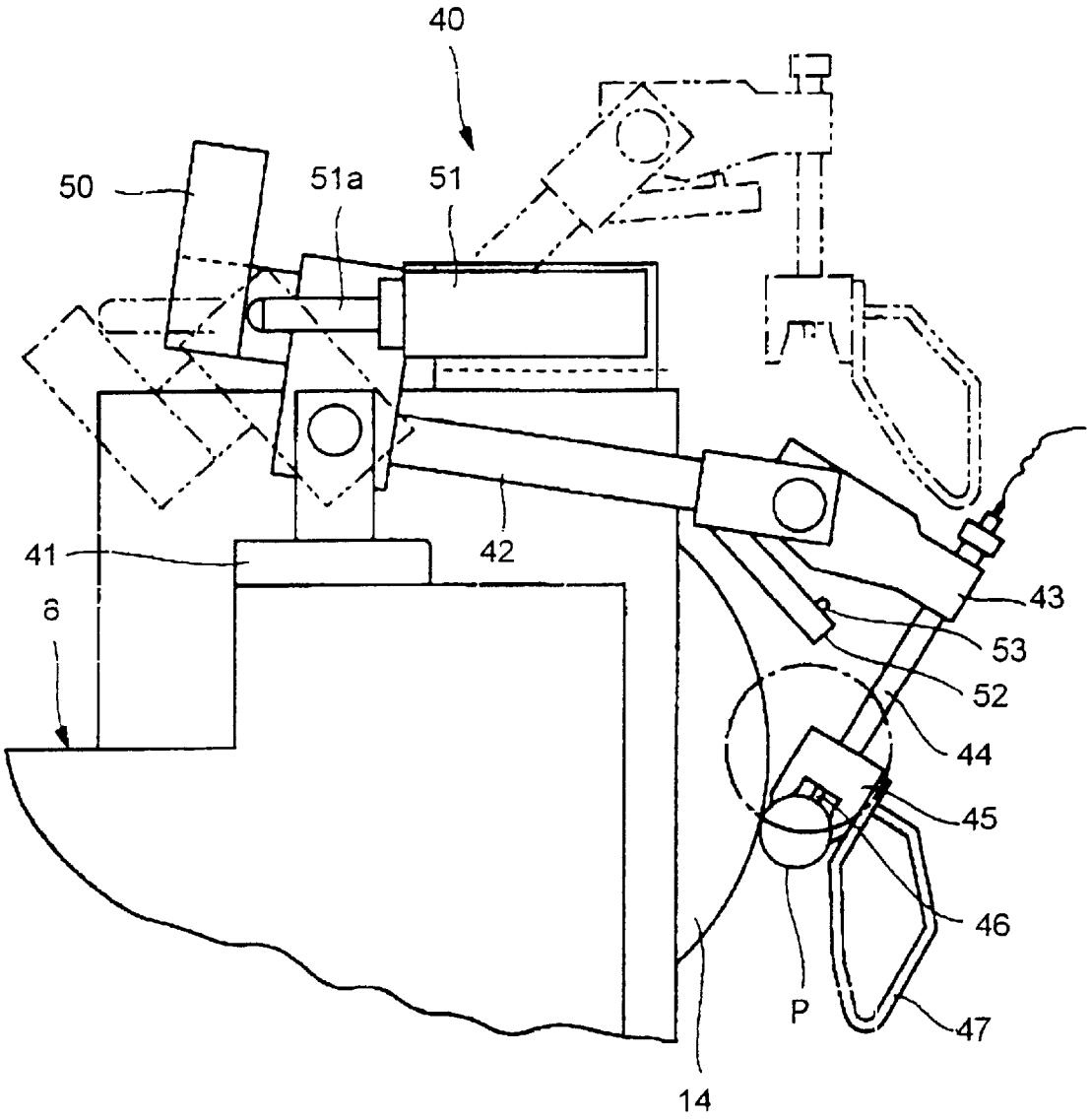
FIG. 2 is a side view showing a sizing unit used in the crank-pin grinding machine of FIG. 1.

As shown in FIG. 2, the crank-pin grinding machine of the present embodiment further includes a sizing unit 40 disposed on the grinding-wheel head 8. The sizing unit 40 is a known following-type sizing unit (for example, that of Marposs S.P.A., Italy), which follows and maintains contact with the revolving crank pin P which is undergoing grinding, to thereby measure the dimension of the crank pin P. The sizing unit 40 includes a support member 41 disposed on the grinding-wheel head 8; a first arm 42 pivotably supported by the support member 41 and extending forward (rightward in FIG. 2); a second arm 43 pivotably supported at a distal end of the first arm 42; and a measuring bar 44 which is fixedly attached to a distal end of the second arm 43 substantially perpendicular to the second arm 43. The measuring bar 44 includes a measuring head, which in turn includes a V block 45 which is fixedly attached to the bottom end of the measuring bar 44; and a probe 46 which is reciprocatively movably disposed at the center of the V block 45. The measuring head detects a reciprocative movement of the probe 46 and outputs an electric signal indicative of the movement. A guide member 47 is fixedly attached to a side surface of the V block 45 and guides the V block 45 for engagement with the crank pin P.

An operating unit is disposed on the grinding-wheel head 8. The operating unit includes a hydraulic cylinder 51. The piston rod 5 la of the hydraulic cylinder 51 abuts an operating block 50 integrated with the first arm 42. The hydraulic cylinder 51 moves the measuring bar 44 between a standby position (represented with an imaginary line) and a measuring position (represented with a solid line). A support block 52 extends forward from the bottom surface of a distal end portion of the first arm 42. A protrusion 53 is formed on the support block 52. When the measuring bar 44 is in the standby position, the protrusion 53 abuts the bottom surface of the second arm 43 to thereby maintain the second arm 43 horizontally. As the piston rod 51 a of the hydraulic cylinder 51 retracts from its extended position, the measuring bar 44 gradually lowers from its standby position. Accordingly, the guide member 47 contacts the crank pin P. Then, being guided along the guide member 47, the crank pin P engages with the V block 45. At this time, the second arm 43 is separated from the protrusion 53 of the support block 52 and is thus rotatable.

Figure 3:
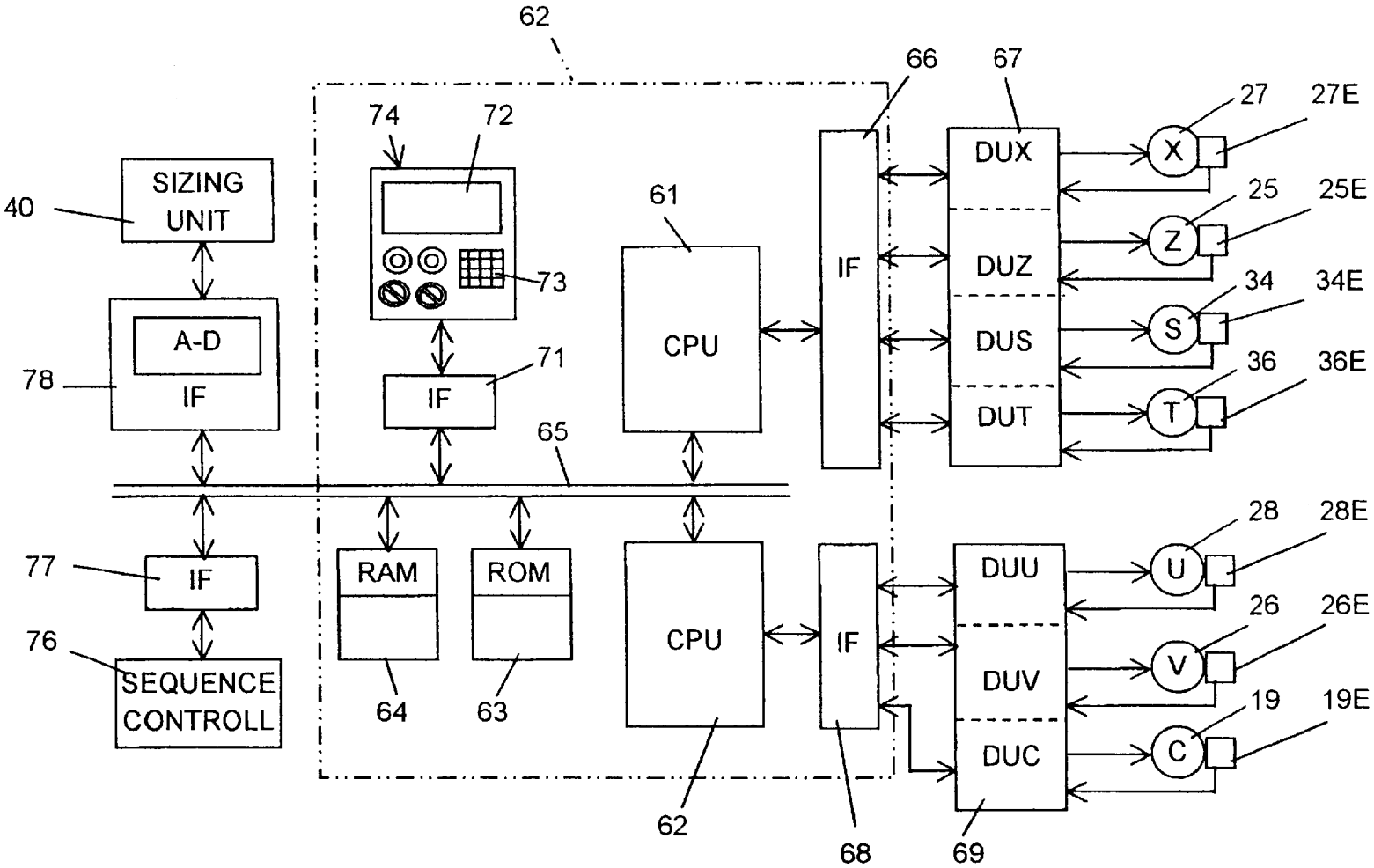
FIG. 3 is a block diagram showing a control system of the crank-pin grinding machine of FIG. 1.

Next, a control system for controlling the crank-pin grinding machine of the present embodiment will be described with reference to FIG. 3. The control system includes a numerical control unit 60, which in turn includes a first CPU 61 and a second CPU 62, a ROM 63, a RAM 64, and a bus 65 for interconnecting the first and second CPUs 61 and 62, the ROM 63, and the RAM 64. The first CPU 61 is connected via an interface 66 to servomotor control circuits of a drive unit 67; specifically, an X-axis servomotor control circuit DUX, a Z-axis servomotor control circuit DUZ, an S-axis servomotor control circuit DUS for controlling the rest unit 30, and a T-axis servomotor control circuit DUT. These servomotor control circuits DUX, DUZ, DUS, and DUT are adapted to operate the corresponding servomotors 27, 25, 34, and 36, and receive a feedback signal from each of the encoders 27E, 25E, 34E, and 36E of the corresponding servo motors.

The second CPU 62 is connected via an interface 68 to servomotor control circuits of a drive unit 69; specifically, a U-axis servomotor control circuit DUU, a V-axis servomotor control circuit DUV, and a C-axis servomotor control circuit DUC. These servomotor control circuits DUU, DUV, and DUC are adapted to operate the servomotors 28 and 26 for feeding the superfinishing-wheel head 9 and the servomotor 19 of the headstock 17, respectively, and receive a feedback signal from each of the encoders 28E, 26E, and 19E of the corresponding servomotors. The first CPU 61 serves as a master, while the second CPU 62 serves as a slave. Thus, the second CPU 62 operates under control of the first CPU 61.

An input/output unit 74 which includes a CRT 72 and a ten-key pad 73 is connected to the bus 65 via an interface 71. A system control program and other necessary data are stored in the ROM 63. A machining control program and other necessary data are stored in the RAM 64. In addition to the numerical control unit 60, a sequence controller 76 is connected to the bus 65 via an interface 77. Further, the measuring head of the sizing unit 40 disposed on the grinding-wheel head 8 is connected to the bus 65 via an interface 78 which includes an A-D converter.

Figure 4:
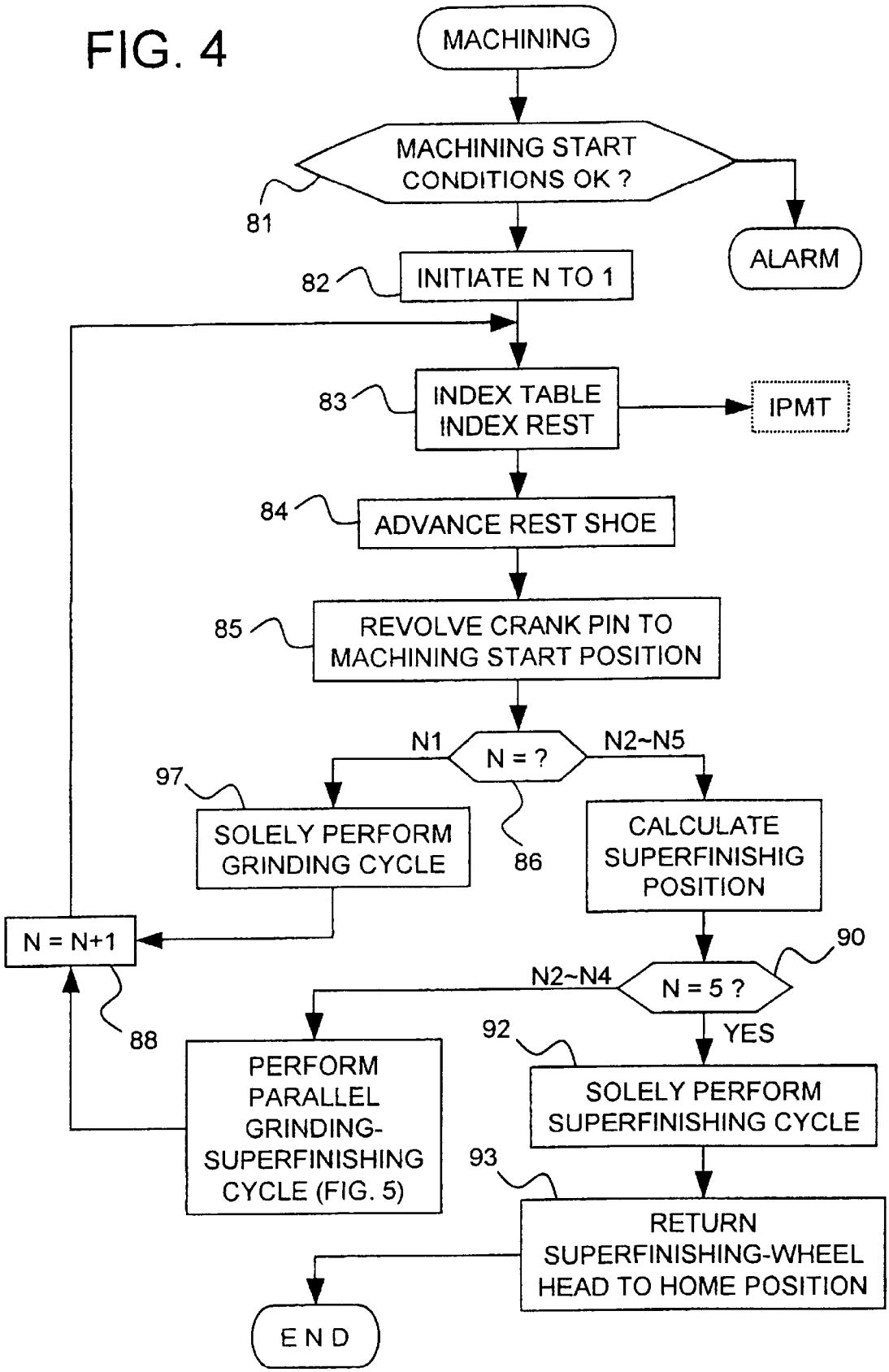
FIG. 4 is a flowchart of a system control program which a numerical control unit of the crank-pin grinding machine of FIG. 1 executes.

A control system which features the present invention will be described with reference to FIG. 4, which is a flowchart showing control steps stored in the ROM 63. A system control program for performing control according to the flowchart is mainly executed by the first CPU 61. The first CPU 61 instructs the second CPU 62 what process to execute. However, for convenience of description, a sharing between the CPUs 61 and 62 of processes is not specified in the description below.

Figure 8A:
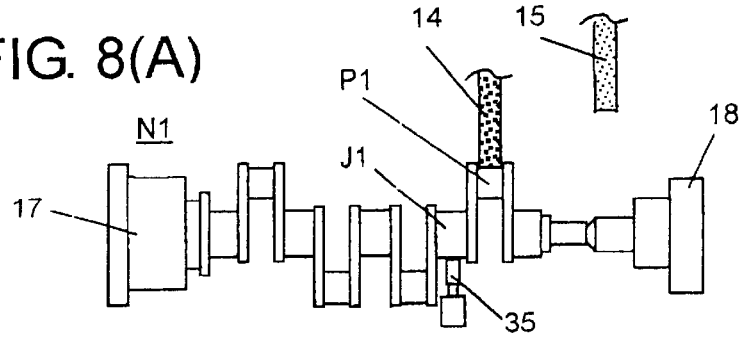
FIGS. 8A–8E are views showing the steps of grinding and superfinishing crank pins.

When an operator inputs a machining start command, a judgment is made whether or not machining start conditions are established (OK) (step 81) In the case of OK, a machining sequence counter N is initialized to 1 (step 82). Next, a table is moved to an index position (step 83). As shown in FIG. 6, an index position memory table IPMT is formed in the RAM 64. When the machining sequence N is specified, a crank pin to be ground, a crank pin to be superfinished, and a journal to be supported by the rest unit 30 are selected on the basis of the contents of the index position memory table IPMT. The contents of the index position memory table IPMT are input in advance by an operator by use of the ten-key pad 73. In this case, since the machining sequence N is set to 1, the servomotor 25 is operated so as to move the left-hand table 6 to an index position where the grinding wheel 14 aligns with the first pin P1 located nearest to the superfinishing wheel 15 (see FIG. 8A).

Figure 9:
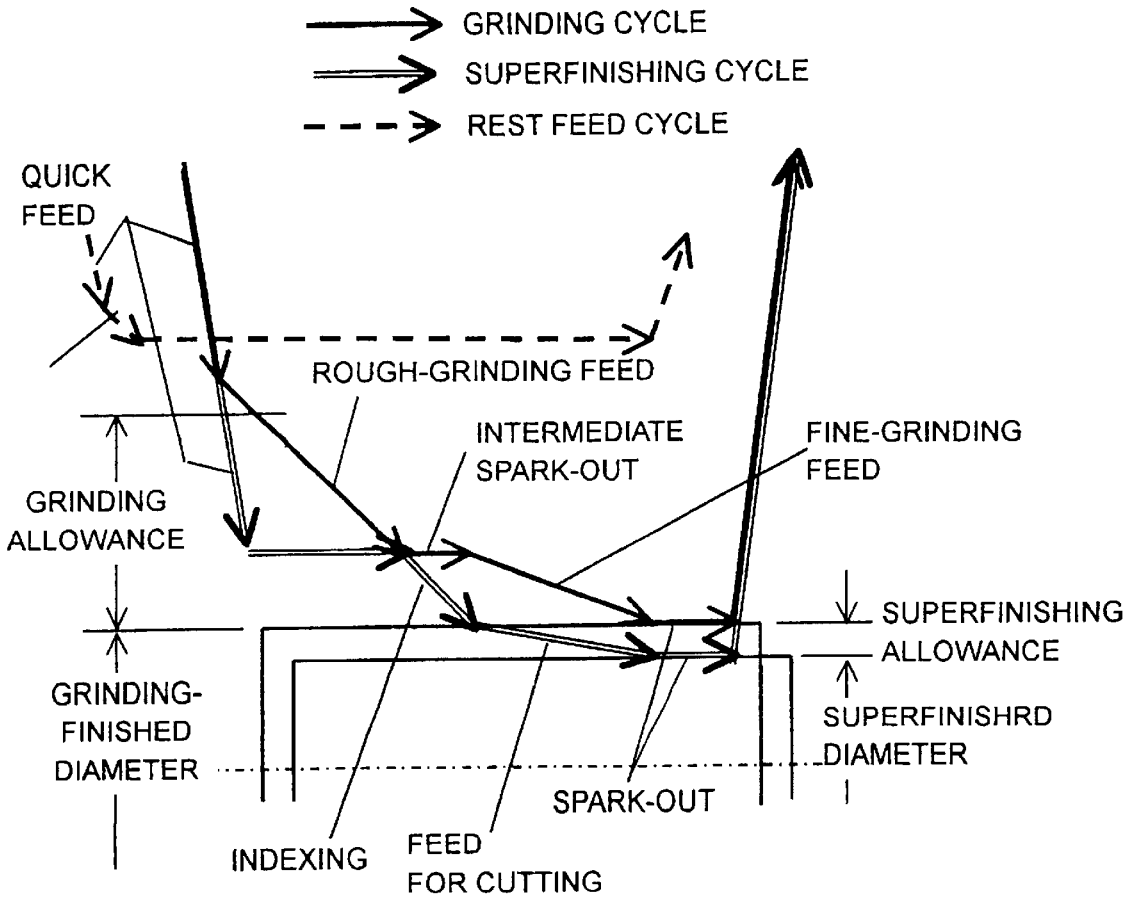
FIG. 9 is a diagram showing interrelations among a grinding cycle, a superfinishing cycle, and a rest feed cycle.

The contents of the index position memory table IPMT indicate that the superfinishing wheel 15 is to be positioned in the home position Rg in the machining sequence N1. However, since the right-hand table 7 is already positioned in its home position, only the left-hand table 6 is moved to an index position as mentioned above. At the same time, the servomotor 34 is operated so as to move the rest head 32 in the Z-axis direction to an index position where the rest shoe 35 aligns with the second journal J2 as specified in the machining sequence N1 of the index position memory table IPMT. Upon completion of movement of the rest head 32 to the index position, the servomotor 36 is operated so as to quickly feed the rest shoe 35 toward the crankshaft W as represented with a dashed line in FIG. 9 (step 84). This amount of advancement is set beforehand such that the rest shoe 35 stops while a certain gap is left between the rest shoe 35 and the journal J2. According to the present embodiment, all of the journals J1–J5 are ground by means of the grinding wheel 14 before machining of the crank pins is started, or are ground beforehand on, for example, a separate multi-wheel grinding machine.

The rest shoe 35 is fed at a slower speed until it lightly contacts the surface of the ground journal J2. The rest shoe is stopped in such a contact position through utilization of a signal issued from a known detector, such as an AE sensor or a vibration sensor. Then, the servomotor 19 is operated so as to revolve the first pin P1 to an indexed machining start position (A) shown in FIG. 10 where the first pin P1 is located nearest to and is horizontally aligned with the grinding wheel 14 (the superfinishing wheel 15) (step 85).

Next, the machining sequence N is judged (step 86). In this case, since the machining sequence N is 1, a grinding cycle is solely performed (step 87). The grinding cycle itself is known. As represented with a solid line in FIG. 9, the grinding cycle includes a quick or rapid feed; a rough-grinding feed; an intermediate spark-out which is performed for a predetermined period of time or while the crankshaft W rotates by a predetermined number of revolutions; a fine-grinding feed; a final spark-out which is performed for a predetermined period of time or while the crankshaft W rotates by a predetermined number of revolutions; and a quick retreat. In order to perform the grinding cycle, the servomotor 27 controls a plunge-cutting operation of the grinding-wheel head 8.

Figure 10:
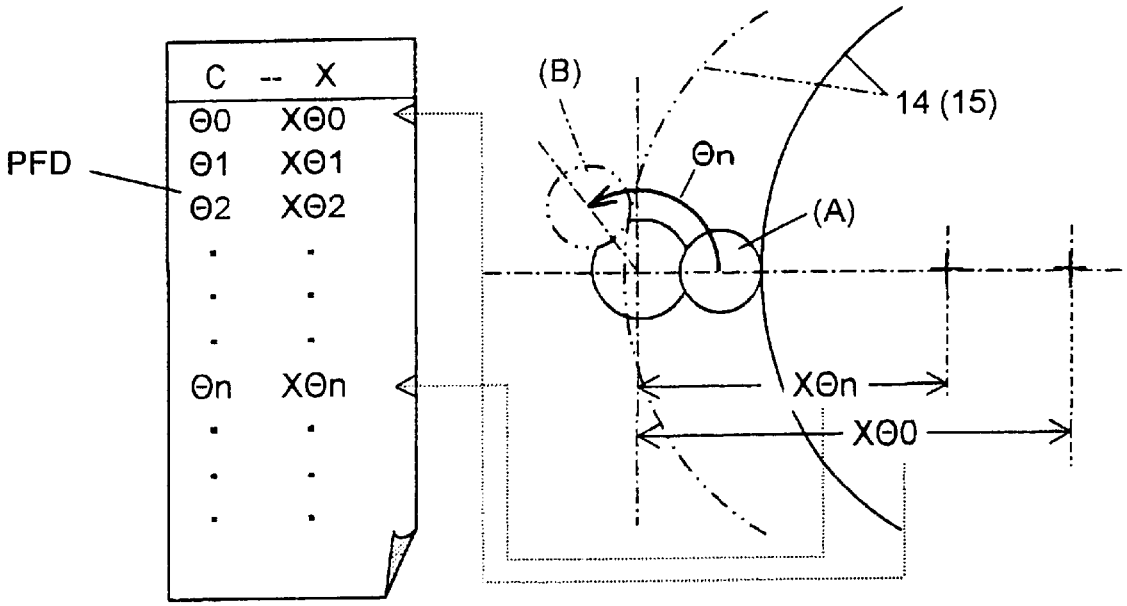
FIG. 10 is a diagram showing the relationship among the phase of revolution of a crank pin, a feed of a grinding wheel or a superfinishing grinding wheel, and profile data.

In rough grinding, the servomotor 19 and the servomotor 27 are synchronized according to profile data PFD shown in FIG. 10. The profile data PFD represents the relationship between the angle (Θn) of revolution of the crank pin P with respect to the machining start position (A) and the position (XΘ) of the grinding-wheel head 8 with respect to the axis of rotation of the crankshaft W, as determined, for example, every 0.5 degrees in the angle of rotation of the crankshaft W. The profile data PFD is stored beforehand in the RAM 64. The servomotor 27 moves the grinding-wheel head 8 such that the grinding wheel 14 advances and retreats according to the profile data PFD while undergoing a rough-grinding feed shown in FIG. 9; i.e., while being fed for cutting against the crank pin P. Thus, the grinding wheel 14 advances and retreats according to the revolving motion of the crank pin P while being gradually fed for cutting.

During rough grinding, the hydraulic cylinder 51 of the sizing unit 40 shown in FIG. 2 causes the piston rod 51 a to retract, whereby the V block 45 engages with the first pin P1 to start measuring. Measurement is started in response to a signal issued from the sequence controller 76. The V block 45 moves to a measuring position in the following manner. While the crank pin P revolves downward from the position (B) of FIG. 10 to its lower position, the V block 45 follows the crank pin P so as to engage with the crank pin P. In this case, in order to more accurately engage the V block 45 with the crank pin P, the speed of rotation of the crankshaft W may be decreased. Alternatively, the crank pin P may be halted in the position (B) of FIG. 10 so as to allow the V block 45 to move to the measuring position.

Then, rough grinding of the first pin PI is started. During rough grinding, the measuring head of the sizing unit 40 monitors the dimension of the first pin P1. When the first pin P1 is ground to a predetermined dimension, the measuring head issues a first sizing signal. In response to the signal, a feed for cutting of the grinding-wheel head 8 is stopped. While the grinding-wheel head 8 is advancing and retreating according to the revolving motion of the crank in P1, intermediate spark-out (depth of cut is zero) grinding is continued until the crankshaft W rotates a predetermined number of revolutions. Thus is completed rough grinding of the first pin P1. The first pin P1 assumes a predetermined degree of roundness. Next, a fine-grinding feed is performed. The grinding-wheel head 8 is fed for cutting at a speed slower than a feed speed for rough grinding. This feed for cutting is combined with an advancement/retreat motion of the grinding-wheel head 8 effected according to the profile data PFD, thereby finish-grinding the first pin P1 at a slower grinding speed. A grinding allowance of the crank pin P is, for example, about 0.6–1.2 mm.

When the first pin P1 is fine-ground to a predetermined dimension, a fine-grinding feed is stopped in response to a second sizing signal issued from the measuring head of the sizing unit 40, followed by final spark-out grinding. Also, in response to the second sizing signal, the rest shoe 35 is retreated to thereby be released from supporting of a journal. Final spark-out grinding is performed until the crankshaft W is rotated a predetermined number of revolutions. The position of the grinding-wheel head 8 as measured when the first pin PI assumes a predetermined phase of revolution, for example, when the first pin P1 returns to the machining start position (A) of FIG. 10, is detected on the basis of an output from the encoder 27E and is stored as "D1" in the column "machining sequence N1" of the wheel position memory table WPMT of FIG. 7. According to a feature of the present invention, each time grinding of each crank pin P is completed, the position "Dn" of the grinding-wheel head 8 during spark-out grinding is stored. On the basis of the stored position Dn, the superfinishing start position of the superfinishing wheel 15 is determined.

Figure 8B:
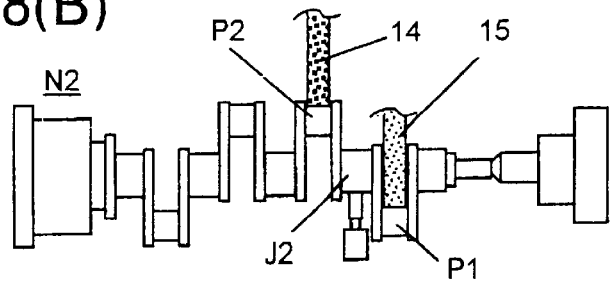

Upon completion of final spark-out grinding and when the position of the grinding-wheel head 8 during final spark-out grinding is stored, the hydraulic cylinder 51 of FIG. 2 is operated in reverse so as to return the sizing unit 40 to the standby position represented with the dashed line in FIG. 2 Also, the servomotor 27 is operated so as to quickly retreat the grinding-wheel head 8 from the crankshaft W. At the same time, the servomotor 19 is stopped, so that the crankshaft W stops rotating. When the grinding-wheel head 8 reaches its retreat end, the machining sequence counter N is incremented by 1 (step 88). Control returns to step 83, and steps 83–86 are repeated as described above. In the subsequent machining sequence N2 of the index position memory table IPMT, the servomotor 25 causes the left-hand table 6 to move to an index position where the grinding wheel 14 aligns with the second pin P2. Also, the right-hand table 7 is moved to an index position where the superfinishing wheel 15 aligns with the first pin P1. In this case, the rest shoe 35 is held in the same position corresponding to the second journal J2. (See FIG 8B.)

Next, the rest shoe 35 is advanced until it gently contacts the second journal J2, to thereby support the second journal J2 (step 84). Operation of the servomotor 19 is controlled such that the second pin P2 is revolved to the position (A) of FIG. 10. When the machining sequence is judged to be other than 1 (step 86), the superfinishing start position is calculated (step 89). Specifically, the superfinishing start position is calculated on the basis of data D1 regarding the position of the grinding wheel 14 as detected upon completion of grinding and stored in the wheel position memory table WPMT and data stored in the RAM 64 regarding the diameters of the grinding wheel 14 and the superfinishing wheel 15 and the difference in feed position between the grinding-wheel head 8 and the superfinishing-wheel head 9. This difference in feed position is obtained beforehand by subtracting the diametral difference between the grinding wheel 14 and the superfinishing wheel 15 from a position difference between the grinding-wheel head 8 and the superfinishing-wheel head 9 as measured when the grinding wheel 14 and the superfinishing wheel 15 is brought in gentle contact with the same crank pin (or a master). If needed, the above calculation may further take. into account feed pitch error characteristics and thermal displacement characteristics of the grinding-wheel and superfinishing-wheel heads 14 and 15.

Figure 5:
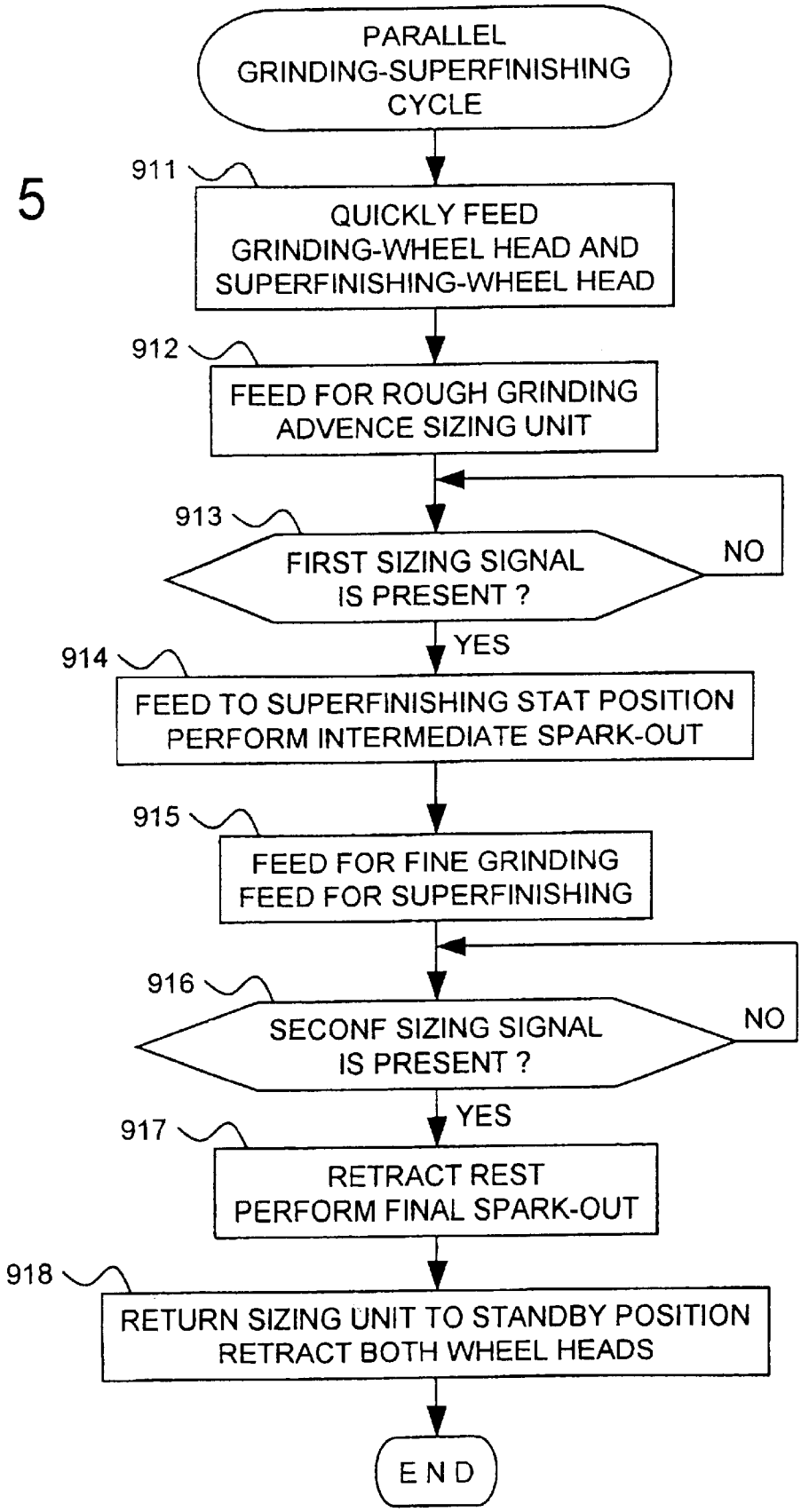
FIG. 5 is a flowchart showing in detail a portion of the flowchart of FIG. 4.

When the thus-calculated superfinishing start position D1' is stored in the field "superfinishing start position" of the machining sequence column. "N2," the machining sequence is again judged (step 90). In this case, since the machining sequence is other than 5, a parallel grinding-superfinishing cycle is performed (step 91). This cycle is performed according to a subroutine shown in FIG. 5. The grinding-wheel head 8 and the superfinishing-wheel head 9 are fed as represented with a solid line and a dual line in FIG. 9. The grinding-wheel head 8 is operated as in the previously mentioned case of a grinding cycle being solely performed. Thus, the operation of the superfinishing-wheel head 9 will mainly be described. First, the servomotor 28 causes the superfinishing-wheel head 9 to be quickly fed toward the first pin P1 in parallel with a quick feed of the grinding-wheel head 8 (step 911). When the superfinishing-wheel head 9 reaches an advanced end of quick feed, the grinding-wheel head 8 is fed for rough grinding, and the sizing unit 40 advances to the measuring position (step 912), while the superfinishing-wheel head 9 stands by at the advanced end until the first-sizing-stage signal indicative of completion of rough grinding is issued (step 913).

When the first-sizing-stage signal is issued, an intermediate spark-out is started. At the same time, advancing and retreating according to rotation of the crankshaft W on the basis of the profile data PFD shown in FIG. 10, the superfinishing-wheel head 9 is fed to the superfinishing start position D1' stored in the wheel position memory table WPMT (step 914). Thus, the superfinishing wheel 15 has reached a position substantially aligned with the ground surface of the first pin P1. Since the superfinishing start position D1' is determined on the basis of the position of the grinding-wheel head 8 as detected during spark-out grinding of the first pin P1 which has undergone rough grinding, when the superfinishing-wheel head 9 is in the superfinishing start position D1', the superfinishing wheel 15 is in gentle contact with the ground surface of the first pin P1; i.e., the depth of cut is zero. As a result, when the superfinishing wheel 15 is fed for superfinishing in parallel with feeding of the grinding wheel 14 for fine grinding of the second pin P2 (step 915), the superfinishing wheel 15 is fed gradually and reliably for cutting by a predetermined superfinishing allowance, while the superfinishing-wheel head 9 advances and retreats synchronously with rotation of the crankshaft W according to the profile data PFD. Thus, the first pin P1 is superfinished to a predetermined diameter without use of the sizing unit 40 of FIG. 20.

When the second-sizing-stage signal is issued from the sizing unit 40 (step 916), as mentioned previously, final spark-out grinding is performed, and, at the same time, the rest shoe 35is retreated (step 917). During final spark-out grinding, the grinding wheel 14 finishes the second pin P2 while the depth of cut is zero. In parallel with final spark-out grinding performed by the grinding wheel 14, the superfinishing wheel 15 performs final finishing of the first pin P1 while the depth of cut is zero. Final spark-out grinding is continued until the crankshaft W is rotated by several revolutions. Upon completion of final spark-out grinding, the sizing unit 40 is returned to its standby position, and the grinding-wheel head 8 and the superfinishing-wheel head 9 are retreated to their retracted ends (step 918), thus completing the parallel grinding-superfinishing cycle, which is composed of grinding of the second pin P2 and superfinishing of the first pin P1.

Figure 8C:
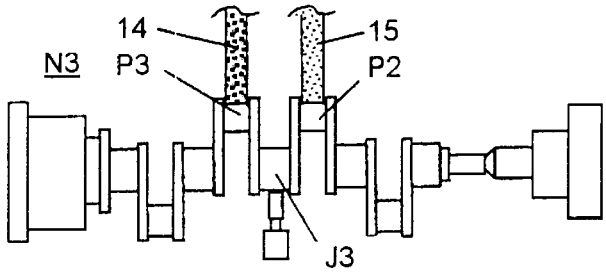
Figure 8D:
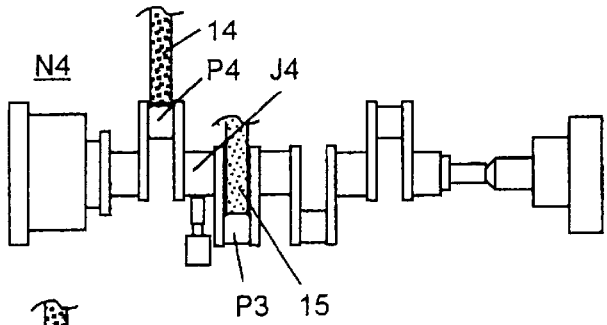
Figure 8E:
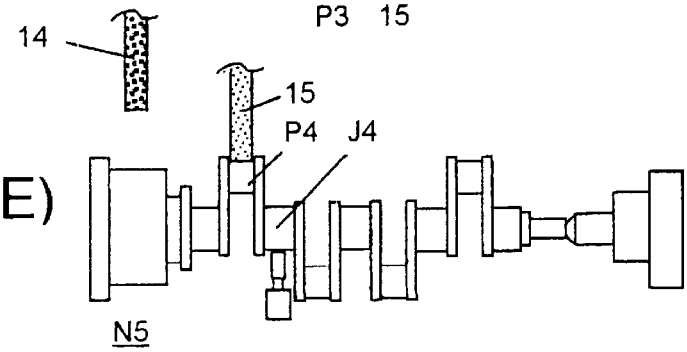

Subsequently, the machining sequence N3 is specified (step 88). The above-described steps 83–91 are repeated. In the machining sequence N3, as shown in FIG. 8C, grinding of the third pin P3 and superfinishing of the second pin P2 are performed in parallel. In the machining sequence N4, as shown in FIG. 8D, grinding of the fourth pin P4 and superfinishing of the third pin P3 are performed in parallel. In the machining sequence N5, the left-hand table 6 returns to its home position, where the grinding wheel 14 faces the chuck 20. As shown in FIG. 8E, a superfinishing cycle is solely performed on the fourth pin P4 (step 92). Basically, this sole superfinishing cycle is performed as represented with the dual line in FIG. 9. However, when the superfinishing-wheel head 15 reaches the advanced end of quick feed, the superfinishing-wheel head 15 is immediately fed to the superfinishing start position without standing by at the advanced end. Upon completion of this sole superfinishing cycle, the right-hand table 7 is moved rightward in FIG. 1 (step 93) to thereby be returned to its home position. Thus are completed grinding and superfinishing of all the crank pins P1–P4.

Notably, in the machining sequence Nos. N3–N5, the rest shoe 35 supports the third journal J3 or the fourth journal J4 as shown in FIGS. 8C–8E. In any of these cases, as seen from FIG. 9, the rest shoe 35 is released from supporting of the journal J3 or J4 in the final stage of superfinishing or simultaneously with start of the final spark-out.

As described above, according to a basic feature of the present invention, object portions for machining of a workpiece, such as crank pins, undergo grinding and superfinishing sequentially while the workpiece is supported in an unchanged manner on a single grinding machine, thereby implementing intensive machining to thereby shorten machining time and improve machining accuracy. Particularly, since the spatial relationship (i.e., relative position) between the superfinishing wheel 15 and the workpiece W can be accurately controlled, the geometrical accuracy of ground portions of the workpiece W which has been achieved through grinding is not impaired. According to another basic feature of the present invention, grinding of one unmachined portion of the workpiece W and superfinishing of one ground portion of the workpiece W are performed in parallel, thereby shortening total time required for grinding and superfinishing all object portions of the workpiece W. According to a further feature of the present invention, in the final stage of superfinishing, a mechanical engagement. between the workpiece W and the rest unit 30 is eliminated, thereby preventing an adverse effect on a superfinished surface which would otherwise result from such a mechanical engagement. According to a still further feature of the present invention, superfinishing of the crank pin P is not subjected to in-process measurement control, thereby avoiding forming a contact mark on a superfinished surface which would otherwise result from contact with the V block of the sizing unit 40 or the probe 46. Nevertheless, crank pins can be superfinished to a desired dimension.

In superfinishing of each crank pin P, the crank pin P is removed by an amount of 5 $\mu$m to 0.02 mm (in diameter) and then undergoes spark-out for finishing. Through use of the index position memory table IPMT, an object portion to be ground, an object portion to be superfinished, and a journal to be supported by the rest shoe 35 can be specified as desired for individual machining sequence Nos. Thus, the machining sequence can be assigned to a plurality of object portions as desired according to characteristics of the workpiece W.

Figure 11:
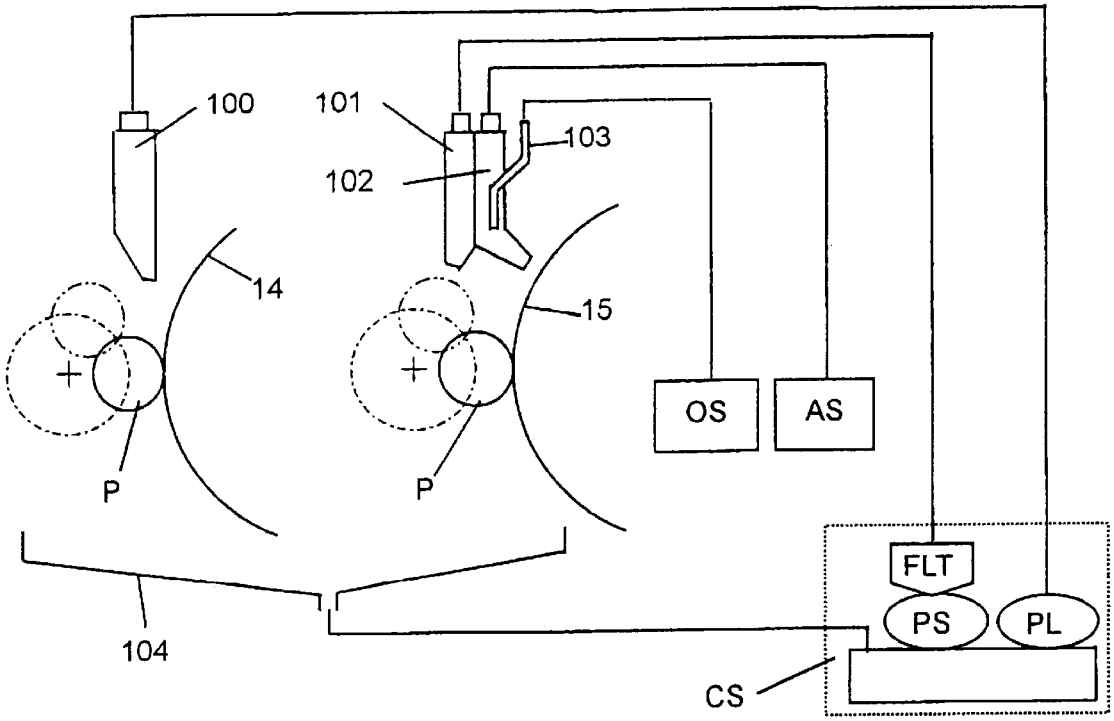
FIG. 11 is a diagram showing a coolant supply system which accompanies the crank-pin grinding machine of FIG. 1.

FIG. 11 shows a coolant supply system which accompanies the crank-pin grinding machine of the present embodiment. This coolant supply system includes a coolant supply unit CS for supplying, for example, a water-soluble coolant, an air supply unit AS, and an oil supply unit OS. The air supply unit AS may be replaced with a plant air supply system. The coolant supply unit CS includes a coolant nozzle 100, which is supported on the grinding-wheel head 8 and has a discharge port directed to a region of grinding; a coolant nozzle 101, which is supported on the superfinishing-wheel head 9 and has a discharge port directed to the crank pin P subjected to superfinishing; and an oil mist nozzle 102, which is supported on the superfinishing-wheel head 9 and is adapted to discharge oil mist over a portion of the superfinishing surface of the superfinishing wheel 15 located upstream of a region of superfinishing. An oil droplet supply tube 103 is projected into the oil mist nozzle 102 and extends to near a discharge port of the oil mist nozzle 102.

A large-capacity pump PL supplies coolant to the coolant nozzle 100 at a rate of 40–50 liters per minute so as to discharge a large amount of coolant toward a region of grinding, thereby suppressing heating of the crank pin P (pin width 20 mm, for example) which undergoes heavy-duty machining. A small-capacity pump PS supplies a small amount of coolant to the nozzle 101 through a filter FLT so as to discharge coolant from the nozzle 101 toward the crank pin P at a rate of about 0.1–0.3 liters per minute per a nozzle width of 10 mm, thereby cooling the crank pin P. The amount of coolant supplied toward the crank pin P during superfinishing is not greater than 1/10 that of coolant supplied toward the region of grinding during grinding. The filter FLT is of fine meshes so as to prevent formation of scratches on a superfinished surface. The filter FLT has a capability of filtering out impurities having a size of, for example, not less than 20 $\mu$m, or a higher filtering capability.

Figure 12:
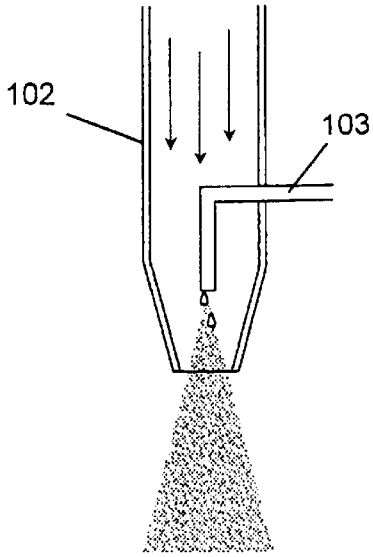
FIG. 12 is a schematic enlarged view showing a mist nozzle of the coolant supply system of FIG. 11.

The air supply unit AS supplies air of 4 atmospheres to the nozzle 102. The oil supply unit OS shown in FIG. 12 supplies oil so as to drop vegetable oil from the tube 103 at a rate of, for example, one to several droplets per second. As a result, while air is discharged from the oil mist nozzle 102 at a rate of 100 liters per minute per a nozzle width of 10 mm, the thus-discharged air causes vegetable oil to be discharged in the form of mist toward the superfinishing wheel 15 at a rate of about 10 cc per hour (0.6 cc per minute) per a nozzle width of 10 mm. In FIG. 11, reference numeral 104 denotes a collector surface formed on the bed 1 or a collector pan disposed on the bed 1 via a heat-insulating material, for collecting coolant.

In the above-described grinding process, the pump PL is operated while the grinding-wheel head 8 is advanced toward the crank pin P from its retracted end. In the above-described superfinishing process, the pump PS, the air supply unit AS, and the oil supply unit OS are operated while the superfinishing-wheel head 9 is advanced toward the crank pin P from its retracted end. In the superfinishing process, while a small amount of coolant is supplied toward the crank pin P, vegetable oil mist is sprayed over the superfinishing wheel 15. Thus, during superfinishing, a dynamic pressure is hardly generated in a contact surface between the crank pin P and the superfinishing wheel 15, thereby improving the surface accuracy of a superfinished surface and preventing an impairment in the geometrical accuracy of the superfinished surface.

Other Embodiments:

In the above-described embodiment, the present invention is embodied in the form of a crank-pin grinding machine. However, the present invention is not limited thereto. The present invention may be applied to a grinding machine for grinding and superfinishing a plurality of axially separated portions of a workpiece; for example, a cylindrical grinder adapted to grind a workpiece having stepped cylindrical portions, a cam shaft grinder, or a crankshaft journal grinder.

According to the above-described embodiment, intensive machining is implemented with respect to grinding and superfinishing of crank pins. However, grinding and superfinishing of the journals J1-J5 may be performed before or after grinding and superfinishing of crank pins are performed. In this case, preferably, the journals J1–J5 undergo grinding and superfinishing in the first step, and the crank pins P1–P4 undergo grinding and superfinishing in the second step. Grinding and superfinishing of the journals J1–J5 are performed in a manner substantially similar to that of grinding and superfinishing of the crank pins P1–P4.

Specifically, in the machining sequence N1, only the first journal J1 undergoes grinding effected by the grinding wheel 14. In the machining sequence N2, the superfinishing wheel 15 superfinishes the first journal J1 which has undergone grinding effected by the grinding wheel 14, in parallel with grinding of the second journal J2. In the machining sequences N3–N5, the third journal J3 and the second journal J2, the fourth journal J4 and the third journal J3, and the fifth journal J5 and the fourth journal J4 undergo grinding and superfinishing in parallel. In the last machining sequence N6, only the fifth journal J5 undergoes superfinishing. In the case where the axial width of a journal is greater than that of a crank pin, grinding and superfinishing of the journal involves known oscillation of the grinding wheel 14 and the superfinishing wheel 15. In grinding and superfinishing of a journal, the grinding wheel 14 and the superfinishing wheel 15 are advanced according to, for example, the grinding cycle of FIG. 9. During grinding and superfinishing according to this grinding cycle, there is no need for synchronization between rotation of the crankshaft W and the advancing motion of the grinding wheel 14 or the superfinishing wheel 15. During grinding, the diameter of a journal in process of grinding is measured by use of the sizing unit of FIG. 1, and the advancing motion of the grinding wheel 14 undergoes in-process control accordingly. When the grinding wheel 14 is to retreat, the position of the grinding-wheel head 8 is stored. When the ground journal is to be superfinished, the spatial relationship (i.e., relative position) between the superfinishing wheel 15 and the ground journal is determined on the basis of the stored position data.

Obviously, numerous modifications and variations of the present invention are possible in light of the above teachings. It is therefore to be understood that within the scope of the appended claims, the present invention may be practiced otherwise than as specifically described herein.

What is claimed is:

1. A combination grinding machine comprising:

a bed;

a workpiece support mechanism disposed on the bed and configured to rotatably support a workpiece having a plurality of axially arranged object portions to be machined;

a first wheel head and a second wheel head disposed on the bed, each configured to be slidable along a common path parallel to an axial direction of the workpiece and in a radial direction perpendicular to the axial direction of the workpiece, the first wheel head and the second wheel head having respective home positions at opposite ends of the common path on the bed;

a grinding wheel supported rotatably on the first wheel head and configured to grind the object portions of the workpiece;

a superfinishing wheel supported rotatably on the second wheel head and configured to superfinish the object portions of the workpiece which have been ground by the grinding wheel;

a first feed unit configured to move the first wheel head in the axial and radial directions;

a second feed unit configured to move the second wheel head in the axial and radial directions; and a numerical control unit configured to control the first and second feed units to move the first and second wheel heads independently of each other in the axial and radial directions of the workpiece such that the axially arranged object portions are first ground by the grinding wheel and then superfinished by the superfinishing wheel.

2. A combination grinding machine according to claim 1, wherein the numerical control unit comprises:

a position storage unit configured to store data regarding a position of the first wheel head as detected upon completion of grinding of each of the object portions; and a control unit configured to control the second feed unit for the second wheel head so as to position a contact point of the superfinishing wheel at a ground surface of the object portion based on position data stored in the position storage unit when superfinishing is started.

3. A combination grinding machine according to claim 1, further comprising:

a rest unit configured to support the workpiece from opposite the grinding wheel of the first wheel head, wherein the numerical control unit is programmed so the rest unit supports the workpiece at least when the grinding wheel performs rough grinding and so the rest unit does not support the workpiece at least when the superfinishing wheel of the second wheel head performs a final stage of superfinishing.

4. A combination grinding machine according to claim 1, wherein the workpiece support mechanism comprises a supporting drive unit configured to rotate a crankshaft about a journal axis to revolve a plurality of crank pins around the journal axis, and wherein, during grinding of one of the plurality of crank pins, a servomotor of the first feed unit for the first wheel head is driven synchronously with a servomotor of the workpiece support mechanism, and during subsequent superfinishing of one of the plurality of crank pins, a servomotor of the second feed unit for the second wheel head is driven synchronously with the servomotor of the workpiece support mechanism.

5. A combination grinding machine according to claim 1, further comprising:

a first supply unit configured to supply a large amount of coolant toward a region of grinding located between the grinding wheel and the object portion during grinding; and a second supply unit configured to supply a small amount of coolant to the object portion and to spray oil mist serving as lubricant over the superfinishing wheel during superfinishing.

6. A combination grinding machine according to claim 5, further comprising:

a filter configured to prevent an entry of foreign matter into the coolant supplied during superfinishing, wherein an amount of the coolant supplied during superfinishing is not greater than 1/10 of that of the coolant supplied to the region of grinding during grinding.

7. A combination grinding machine according to claim 4, wherein the numerical control unit is configured such that, before or after the plurality of crank pins are ground and superfinished, a plurality of journals of the crankshaft are ground and superfinished.

8. A combination grinding machine according to claim 1, wherein the numerical control unit is configured to control the first and second feed units such that, after initially grinding the object portion which is located near a home position of the second wheel head, the grinding wheel of the first wheel head sequentially grinds the remaining object portions while the first wheel head is returning to a home position of the first wheel head, and such that the superfinishing wheel of the second wheel head sequentially superfinishes the object portions which have been ground by the grinding wheel, while the second wheel head is moving toward the home position of the first wheel head, in parallel with the grinding which is performed by the grinding wheel.

9. A combination grinding machine according to claim 8, wherein the numerical control unit comprises:

a position storage unit configured to store data regarding a position of the first wheel head as detected upon completion of grinding of each of the object portions; and a control means unit configured to control the second feed unit for the second wheel head so as to position a contact point of the superfinishing wheel at a ground surface of the object portion based on position data stored in the position storage unit when superfinishing is started.

10. A combination grinding machine according to claim 8, further comprising:

a rest unit configured to support the workpiece from opposite the grinding wheel of the first wheel head, wherein the numerical control unit is programmed such that the rest unit supports the workpiece at least when the grinding wheel performs rough grinding and such that the rest unit does not support the workpiece at least when the superfinishing wheel of the second wheel head performs a final stage of superfinishing.

11. A combination grinding machine according to claim 8, wherein the workpiece support mechanism comprises a supporting drive unit configured to rotate a crankshaft about a journal axis to thereby revolve a plurality of crank pins around the journal axis, and wherein during grinding of one of the plurality of crank pins, a servomotor of the first feed unit for the first wheel head is driven synchronously with a servomotor of the workpiece support mechanism, and during subsequent superfinishing of one of the plurality of crank pins, a servomotor of the second feed unit for the second wheel head is driven synchronously with the servomotor of the workpiece support mechanism.

12. A combination grinding machine according to claim 8, further comprising:

a first supply unit configured to supply a large amount of coolant toward a region of grinding located between the grinding wheel and the object portion during grinding; and a second supply unit configured to supply a small amount of coolant to the object portion and spraying oil mist serving as lubricant over the superfinishing wheel during superfinishing.

13. A combination grinding machine according to claim 11, wherein the numerical control unit is configured such that, before or after the plurality of crank pins are ground and superfinished, a plurality of journals of the crankshaft are ground and superfinished.

14. A combination grinding machine according to claim 1, wherein the numerical control unit is configured such that the grinding wheel of the first wheel head grinds each of the object portions according to a grinding cycle including a rough grinding, in which a feed speed for cutting is relatively high, and a fine grinding, in which a feed speed for cutting is relatively low, and such that the superfinishing wheel of the second wheel head superfinishes a ground object portion in parallel with the fine grinding.

15. A combination grinding machine according to claim 14, wherein the numerical control unit comprises:

a position storage unit configured to store data regarding a position of the first wheel head as detected upon completion of grinding of each of the object portions; and a control unit configured to control the second feed unit for the second wheel head so as to position a contact point of the superfinishing wheel at a ground surface of the object portion on the basis of position data stored in the position storage means when superfinishing is started.

16. A combination grinding machine according to claim 14, further comprising:

a rest unit configured to support the workpiece from opposite the grinding wheel of the first wheel head, wherein the numerical control unit is programmed such that the rest unit supports the workpiece at least when the grinding wheel performs rough grinding and such that the rest unit does not support the workpiece at least when the superfinishing wheel of the second wheel head performs a final stage of superfinishing.

17. A combination grinding machine according to claim 14, wherein the workpiece support mechanism comprises a supporting drive unit configured to rotate a crankshaft about a journal axis to thereby revolve a plurality of crank pins around the journal axis, and wherein during grinding of one of the plurality of crank pins, a servomotor of the first feed unit for the first wheel head is driven synchronously with a servomotor of the workpiece support mechanism, and during subsequent superfinishing of one of the plurality of crank pins, a servomotor of the second feed unit for the second wheel head is driven synchronously with the servomotor of the workpiece support mechanism.

18. A combination grinding machine according to claim 14, further comprising:

a first supply unit configured to supply a large amount of coolant toward a region of grinding located between the grinding wheel and the object portion during grinding; and a second supply unit configured to supply a small amount of coolant to the object portion and spraying oil mist serving as lubricant over the superfinishing wheel during superfinishing.

19. A combination grinding machine according to claim 17, wherein the numerical control unit is configured such that, before or after the plurality of crank pins are ground and superfinished, a plurality of journals of the crankshaft are ground and superfinished.

20. A method for grinding a workpiece by using a combination grinding machine, comprising:

holding the workpiece with a workpiece support mechanism disposed on a bed, the workpiece support mechanism being configured to rotate around an axial axis of the workpiece;

grinding the workpiece with a grinding wheel supported rotatably on a first wheel head disposed on the bed and movable along the axial axis of the workpiece and a radial axis perpendicular to the axial axis of the workpiece;

superfinishing the workpiece with a superfinishing wheel supported rotatably on a second wheel head disposed on the bed and movable along the axial axis and the radial axis of the workpiece;

moving the grinding wheel in the axial and radial directions with a first feed unit;

moving the superfinishing wheel in the axial and radial directions with a second feed unit, wherein the steps of moving the grinding wheel and moving the superfinishing wheel are performed independently of each other and are controlled by a numerical control unit.

21. A method according to claim 20, further comprising:

supporting the workpiece with a rest unit disposed opposite to the grinding wheel at least when the grinding wheel performs grinding.

22. A method according to claim 20, wherein the step of grinding the workpiece further comprises driving a servomotor of the first feed unit synchronously with a servomotor of the workpiece support mechanism.

23. A method according to claim 20, wherein the step of superfinishing the workpiece further comprises driving a servomotor of the second feed unit synchronously with a servomotor of the workpiece support mechanism.

24. A method according to claim 20, further comprising:

supplying a large amount of coolant towards a region located between the grinding wheel and the workpiece;

supplying a small amount of coolant towards a region located between the superfinishing wheel and the workpiece; and spraying oil mist as lubricant over the superfinishing wheel during superfinishing.

25. A method according to claim 20, further comprising:

storing data regarding a position of the first wheel head as detected upon completion of grinding; and controlling the second feed unit of the second wheel head so as to position a contact point of the superfinishing wheel at a ground surface of the workpiece on a basis of position data stored in a position storage unit when superfinishing is started.

* * * * *

UNITED STATES PATENT AND TRADEMARK OFFICE

CERTIFICATE OF CORRECTION

PATENT NO. : 6,409,573 B1
DATED : June 25, 2002
INVENTOR(S) : Mukai et al.

It is certified that error appears in the above-identified patent and that said Letters Patent is hereby corrected as shown below:

Title page,
Item [73], Assignee should read:

-- [73] Assignee: Toyoda Koki Kabushiki Kaisha,
Kariya (JP) --

Signed and Sealed this

Eleventh Day of February, 2003

JAMES E. ROGAN
*Director of the United States Patent and Trademark Office*